United States Patent [19]

Jinno et al.

[11] 4,207,016

[45] Jun. 10, 1980

[54] METHOD AND APPARATUS FOR SUPPORTING THE WALL OF AN UPWARDLY EXCAVATED SHAFT

[75] Inventors: Takayuki Jinno; Yasuo Kotake; Toshihiro Kikuchi, all of Ohdate, Japan

[73] Assignee: Dowa Mining Co., Ltd., Japan

[21] Appl. No.: 908,631

[22] Filed: May 23, 1978

[30] Foreign Application Priority Data

May 31, 1977 [JP] Japan ..... 52-63644
Jul. 2, 1977 [JP] Japan ..... 52-79291

[51] Int. Cl.[2] ..... E21D 3/00; E21D 19/00

[52] U.S. Cl. ..... 405/133; 175/171; 299/12; 405/150

[58] Field of Search ..... 405/133, 151, 153, 144, 405/145, 136, 137; 175/171, 53; 299/56, 55, 12

[56] References Cited

U.S. PATENT DOCUMENTS

| | | | |
|---|---|---|---|
| 752,931 | 2/1904 | Smith | 405/144 |
| 984,337 | 2/1911 | Woodworth | 405/153 |
| 2,182,477 | 12/1939 | Hollingsworth | 175/171 X |
| 3,604,754 | 9/1971 | Kampf-Emden et al. | 299/56 X |
| 3,840,272 | 10/1974 | Crane et al. | 405/138 X |

*Primary Examiner*—Dennis L. Taylor
*Attorney, Agent, or Firm*—Wenderoth, Lind & Ponack

[57] ABSTRACT

There is provided a method and apparatus for supporting the wall of an upwardly excavated shaft. Cylindrical support frames which are successively thrust up through the shaft are respectively composed of several arcuate members and one or more disjointing members. A plurality of top supporting plates are provided on the top of the series of the cylindrical frames and are designed to fall inwardly toward the center of the shaft after the excavation of the shaft is terminated, thus constructing an umbrella like device for supporting the roof of the shaft.

11 Claims, 14 Drawing Figures

Fig. 2a
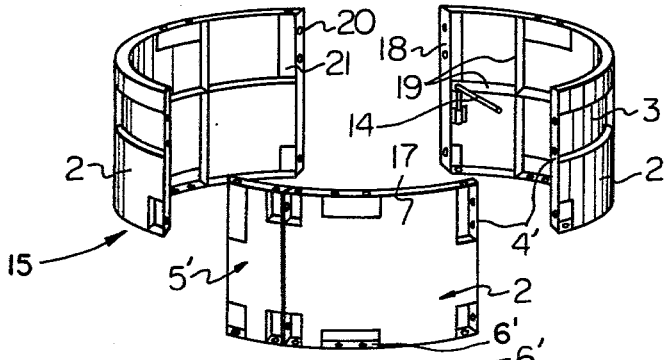
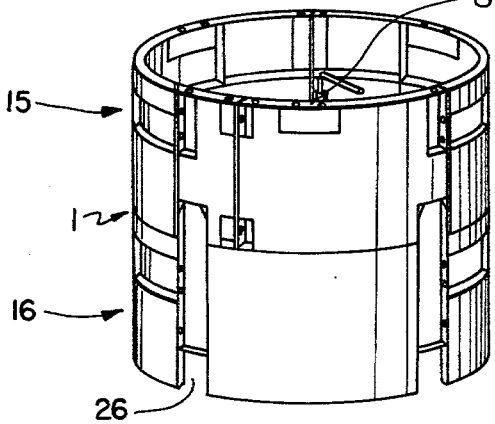
Fig. 2b
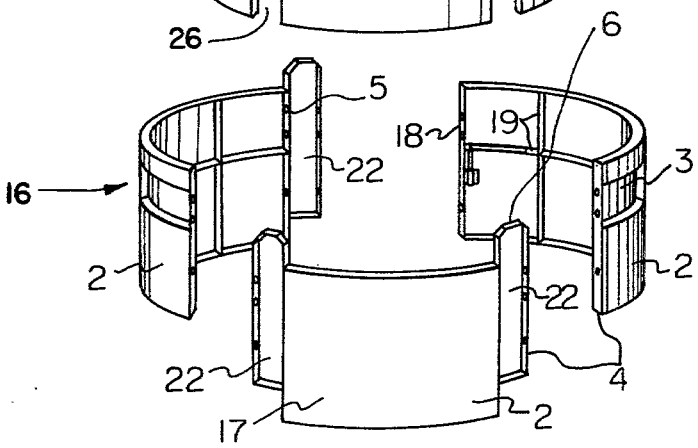
Fig. 2c

METHOD AND APPARATUS FOR SUPPORTING THE WALL OF AN UPWARDLY EXCAVATED SHAFT

BACKGROUND OF THE INVENTION

The present invention relates to a method and apparatus for supporting the wall of an upwardly excavated shaft without requiring workmen to approach the wall to be supported or shielded.

Heretofore, the process for supporting the wall of an upwardly excavated shaft generally included scaffolding in the shaft, delivering frame members up into the shaft one after another and then manually putting the frame together to complete the shielding. Such a manner of shielding naturally required the workmen to carry out their labor at the risk of falling, and further involved the danger of the destruction of the roof and the side wall or vertical wall of the shaft, as well as unsanitary conditions due to the dusty and stagnant environment.

In order to eliminate the above mentioned defects of the old techniques, the inventors developed, as disclosed in Japanese Patent Application No. 37542/1976, corresponding to U.S. application Ser. No. 895,103, a system for carrying out upwardly directed full face cutting accompanied by shielding of the wall, which comprises the steps of upwardly cutting a predetermined length of a shaft by a rotary bit and supporting the corresponding length of thus shaped side wall by means of at least one cylindrical frame section, whereby each of such two steps are carried out repeatedly. While such system brought about remarkable improvements in shielding or supporting the wall of an upwardly directed shaft without requiring workmen to enter into the shaft, the inventors found that the shielding of the wall including the side wall or vertical wall and the roof can be more beneficially made by providing a novel side wall support frame and a roof support frame each of which will be explained in detail hereinafter.

SUMMARY OF THE INVENTION

According to the present invention there is provided the side wall support frame which is not required to be fabricated in the shaft. Instead, each of the frame sections is adapted to be fabricated beneath the shaft and combined successively in the axial direction so as to be thrust upwardly into the shaft to form a series of side wall support frames.

According to the present invention there is also provided a device for supporting the roof of the shaft, which after completion thereof enables the cutting machine to be withdrawn from the shaft, as will be explained hereinafter, to allow the workmen to pass carefreely through the shaft.

Thus one object of the present invention is to provide a side wall support frame which can easily be fabricated, disjointed and thrust up into the shaft. The other object of the present invention is to provide a roof support frame which can automatically cover the roof when excavation is terminated. Other objects and advantages of the present invention will be clarified in the following description with reference to the accompanying drawings.

BRIEF DESCRIPTION OF THE ACCOMPANYING DRAWINGS

FIG. 1 is a perspective view of the support frames according to the present invention used for shielding;

FIG. *2a* is an exploded perspective view of one type of support frame according to the present invention;

FIG. *2b* is a perspective view of two types of support frames of the present invention, shown assembled to each other;

FIG. *2c* is an exploded perspective view of another type of support frame of the present invention;

FIGS. *3a* and *3b* are enlarged elevation and section views of the fabrication of a cylindrical support frame of the type shown in FIG. *2c;*

FIG. 4 is a perspective view illustrating the support of the shaft roof;

FIGS. *5a*, *5b* and *5c* are an elevation view of a roof supporting means according to the present invention, in the stretched condition, a plan view thereof, and a side view thereof;

FIG. 6 is a perspective, partially exploded view of the device of the present invention; and FIGS. 7 to 9 inclusive are perspective views illustrating processes involving the use of the present invention and illustrative of the mechanism thereof.

DESCRIPTION OF THE PREFERRED EMBODIMENTS

Figure 1:
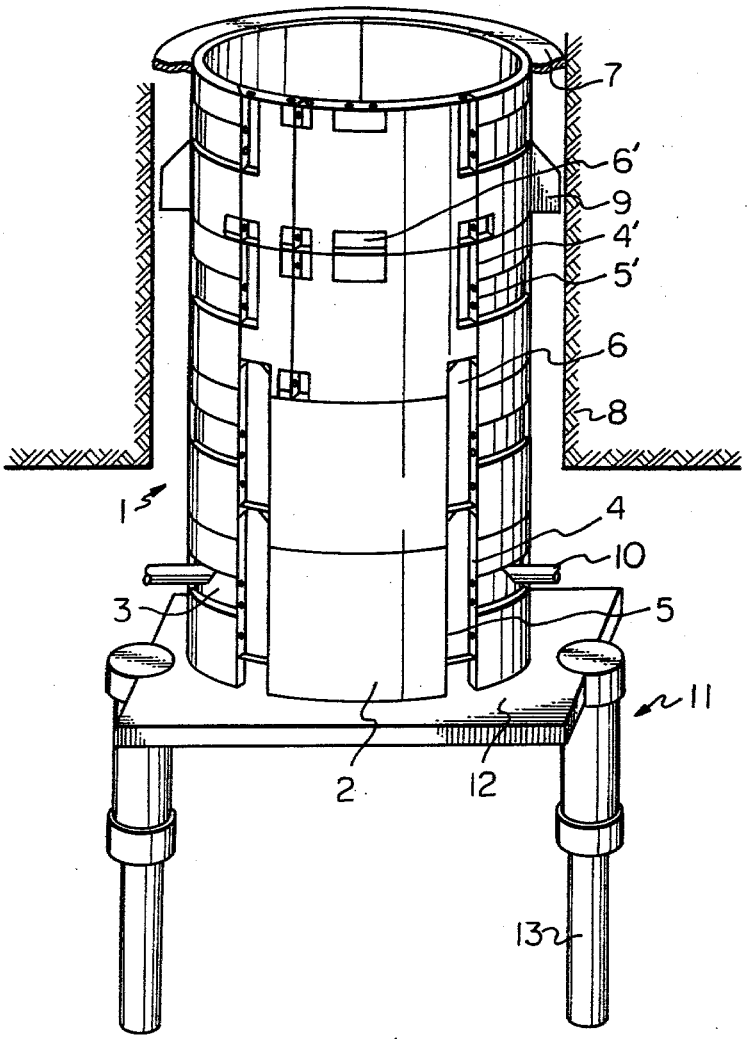
Figure 3A:
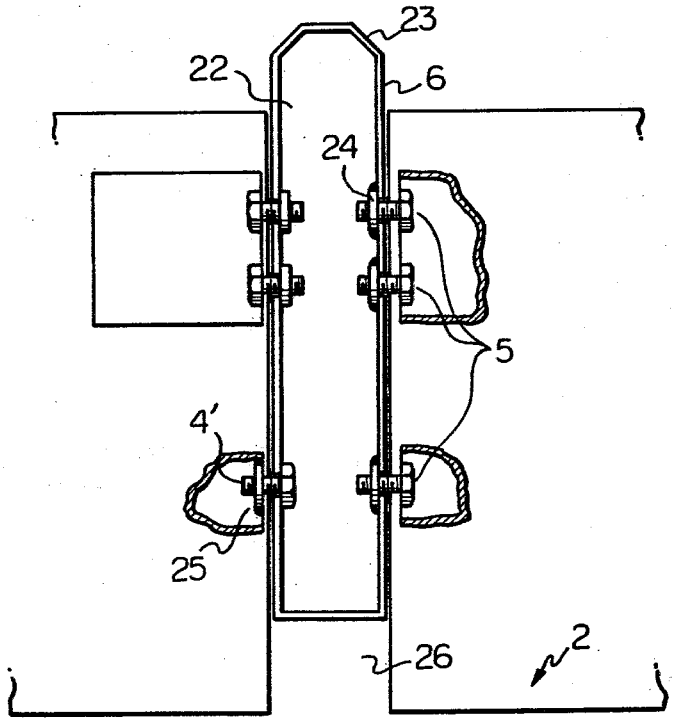
Figure 3B:
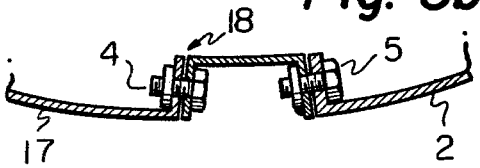

At first, the cylindrical support frame according to the present invention will be explained in detail. As shown in FIG. 1, each of the cylindrically configurated support frames 1 is fabricated on an upwardly and downwardly movable fabrication table 12 and is connected to adjacent frames in vertical alignment. The fabrication table 12 is driven up and down by means of a hydraulic cylinder 13 as shown in FIG. 1, but may otherwise be driven by a suitable hoisting means.

A series of cylindrical frames 1 fabricated and connected as mentioned above is thrust upwardly by support frame thrusting means 11 until support frame holding means 3 on the surface of an arcuate member 2 reaches a position adapted to be engaged with another support frame locking means 10 extending from the exterior of a shaft. The arcuate member 2 is a constituent of the support frame 1 as will be understood from FIG. 1. The support frame thrusting means 11 consists of the formerly mentioned fabrication table 12 and the hydraulic cylinder 13, and is adapted to thrust the series of the frames 1 up into the shaft.

As shown in FIG. 1, the support frame holding means 3 is formed as a depression in the side wall of the arcuate member 2. When the support frame locking means 10 in the form of a horizontally movable member is inserted into the depression 3, the series of cylindrical frames 1 is held by the locking means 10.

Next, the fabrication table 12 is lowered away from the cylindrical frame 1, and another or new frame 1 is fabricated thereon. Then the new frame 1 is thrust upwardly by thrusting up means 11 until it contacts the next upper or preceding frame 1 for engagement therewith. After the lower frame 1 is connected to the upper frame, the support frame locking means 10 is extracted from the depression 3, and the prolonged series of frames 1 is then freely movable in the up and down directions. With such a condition maintained, the series of frames 1 is further thrust upwardly by thrusting up means 11 until the lower frame 1 reaches the position to be engated with the formerly mentioned locking means 10 extending from the exterior of the shaft. The locking means 10 is then actuated to hold the prolonged series of frames 1 in the shaft.

The above mentioned processes are successively repeated to complete framing of the side wall or vertical wall of a predetermined length of the shaft without requiring manual framing.

The support frame used in the present invention is made up from iron plate or concrete block. In view of the considerable weight and large dimensions thereof, one support frame or frame section can be disjointed into several arcuate members 2 to facilitate removal and fabrication thereof. It is to be noticed that, due to such disjointable construction, the cylindrical frame 1 can be fabricated even when a boring rod is located at the center of the shaft and, therefore, permits the frame 1 to be thrust upwardly while the boring rod is in the shaft.

FIGS. *2a–2c* illustrate the fabrication of two types of support frames. The disjointed cylindrical frame 15 shown in FIG. *2a* is of the "hole" type and comprises three arcuate members 2 and one extractable member 5'. Two of the arcuate members have holding means or depressions 3 positioned such that depressions 3 will be diametrically opposed to one another when the frame is completed. As shown, each of the arcuate members has flange members 18 which extend inwardly from the periphery of the side wall of an arcuate iron plate 17. At the inside of the iron plate 17, skeleton members 19 are jointed to the peripheral flange members 18 to extend vertically as well as horizontally. A horizontal skeleton member has a slot into which an openable and closeable member 14 is inserted.

Connecting means 4' provided on the arcuate members 2 and the extracting member 5' are brought into conjunction by inserting and tightening bolts into slots 20 in the flange members 18. Means 6' for connecting lower frames with upper ones alike are connected by bolts through slots 20. The iron plates 17 are cut out at portions adjacent to the slots 20 to form openings 21, through which a workman can manipulate a spanner or similar bolt-tightening tools while keeping his body outside the cylindrical frame.

Fabrication of cylindrical frame 1 is carried out with ease because the flange members 18 are directed radially. But, when it is desired to disjoint the frame 1 from inside thereof, workmen will find it difficult to extract arcuate members because of the angular relationship given by the flange members. For overcoming this difficulty, extracting member 5' is disposed between and jointed to two of the arcuate members as a disjointing member, and the two faces of contact are sloped to depict an angle divergent inwardly. Once this extracting member is firstly disconnected by removing connecting bolts, the other members can be readily disconnected.

In the lower portion of FIG. *2b* and in FIG. *2c*, a frame 16 of the "channel" type is shown as having three arcuate members 2 and three channel members 22. As with the "hole" type frame 15, the channel type frame 16 has depressions 3, flange members 18 and skeleton members 19. As shown in FIGS. *3a* and *3b*, the channel member 22 is jointed to the flange member 18 extending from the periphery of the iron plate 17 by means of a bolt and nut system. The upper end of the channel member 22 is tapered as shown in FIGS. *3a* and *3b*. As further shown in FIGS. *3a* and *3b*, slots 20 are provided in flanges 18 and in sides of the channels 22 for insertion therethrough of bolts 5. Some of the bolts are engaged with connecting nuts 24 and are inserted from the inner portion of the arcuate member through the slots 20, thereby initially connecting channels 22 to the members 2. As shown, the channel member 22 is connected to the arcuate member in a manner to project upwardly from the arcuate member.

Such units of connected arcuate members and channel members are carried onto the fabricating table 12 as shown in FIG. 1. For the purpose of connecting such units, the flange member 18 at the side of each arcuate member where a channel member is not yet connected has connecting nuts 25 secured to the inner surface thereof in alignment with the bolt slots 20. The flange member 18 at the side of the channel member where an arcuate member is not yet connected is connected to the formerly mentioned flange member 18 at the side of the arcuate member by inserting bolts from inside of the channel member through bolt slots 20 and tightening the bolts in nuts 25.

By completing the above mentioned fabricating process, there is provided a cylindrical frame wherein the three channel members are projected upwardly by a predetermined distance, consequently forming cuts or recesses 26 as the lower end thereof with flange members 18 therearound. The projecting end 6 of the channel member 22 and the cut 26 at the lower end of the cylindrical frame constitute means for successively connecting the cylindrical frames. Thus at the time of connecting two cylindrical support frames of the channel type, each of the three projecting ends 6 of the channel members 22 is inserted into a respective of the cuts 26. By virtue of the taper 23 at the top of the projecting end, fine adjustment for alignment is not required at the time of connection.

For disjoining the cylindrical frame of the channel type, the bolts engaged with the nuts 25 are disconnected from inside of the channel member. Because the nuts 25 themselves are firmly fixed to the flange member 18 of the arcuate member, they are prevented from being rotated together with the bolts.

As compared with the hole type frame, the channel type frame excels in easy construction and fabrication. But since in the channel type frame an arcuate member 2 cannot be extracted in the horizontal direction, it is preferred in practice to provide a series of frames wherein several upper frames are of the hole type 15 and the lower frames are of the channel type 16, thus enabling the arcuate members 2 of the channel type to be extracted upwardly in the axial direction. In this connection the lowermost cylindrical support frame of the hole type is provided with cuts at the lower end thereof, which receive the projecting ends of the channel members of the uppermost support frame of the channel type, to thus ensure the connection between the two types of frames, as shown in FIG. *2b*.

It is preferable to provide a rubber plate 7 (FIG. 1) appropriately disposed on the uppermost surface of the cylindrical frame for preventing the fall of rock through the annular space between the side wall 8 and the frames 1.

It is also preferable to have guide members 9 made of iron and disposed at the appropriate positions on the frame to maintain the series of cylindrical frames parallel to the side wall 8.

As explained above, the support frame according to the present invention is used for supporting a side wall or vertical wall of the shaft while excavating the same without requiring workmen to enter into the shaft, and can be fabricated beneath the shaft and by manipulation from the outside of the frame. Further, the support frame can be disjointed by manipulation from the inside. These features bring about great advantages in supporting the side wall of the shaft.

Figure 4:
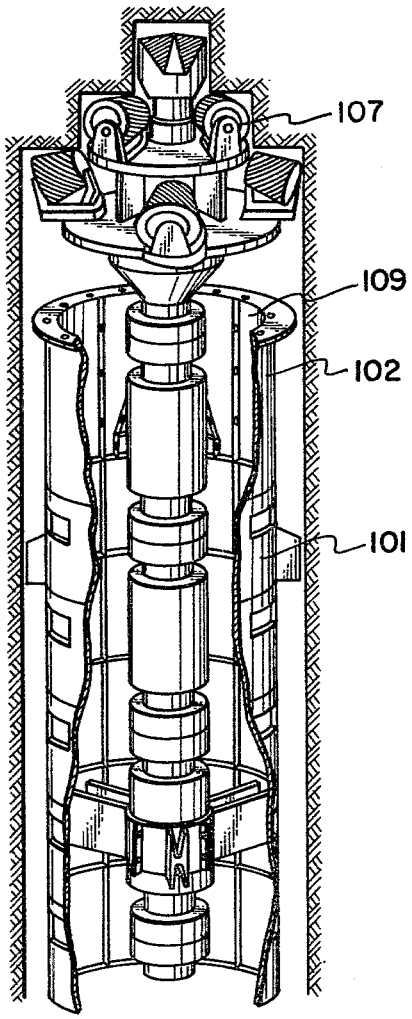

After the excavation of the shaft is terminated and the side wall or the vertical wall of the shaft is supported by the support frames, the roof of the shaft must be supported by appropriate means to check falling of rocks therefrom. In this connection the technique of supporting the roof of a shaft in accordance with aforementioned Japenese Patent Application is shown in FIG. 4, wherein a drill bit 107 equal in diameter to the shaft serves to support the roof of the shaft. In using this type of roof supporting means, workmen may safely ascend and descend the shaft because the bit itself checks falling of rocks. However, the workmen cannot perform the task of supporting the roof by means of a separate support frame because of the presence of the cutting bit 107.

Under such circumstances the workmen were previously obliged to carry out the toilsome and dangerous work of cutting upwardly near the bit to then cut and support the roof on the bit.

To overcome the above mentioned difficulties, the present invention provides a device for supporting the roof without requiring workmen to enter therein, which is shown in FIGS. 4 to 9 inclusive. Thus the present invention provides a method for supporting the roof of a shaft without requiring workmen to ascend to the roof, which method includes the steps of upwardly cutting a predetermined length of the shaft by a cutting bit and supporting the corresponding length of the thus shaped side wall or vertical wall by means of cylindrical side frames, whereby the cutting work and the supporting work are both carried out repeatedly, contracting the diameter of the bit to allow the same to pass down through the shaft, and pulling down at least a part of the uppermost support frame inwardly to form a top supporter adapted to support the roof. The present invention further provides means for carrying out the method of supporting the roof. The following description will explain the method and device for supporting the roof.

Figures 5A, 5B, 5C:
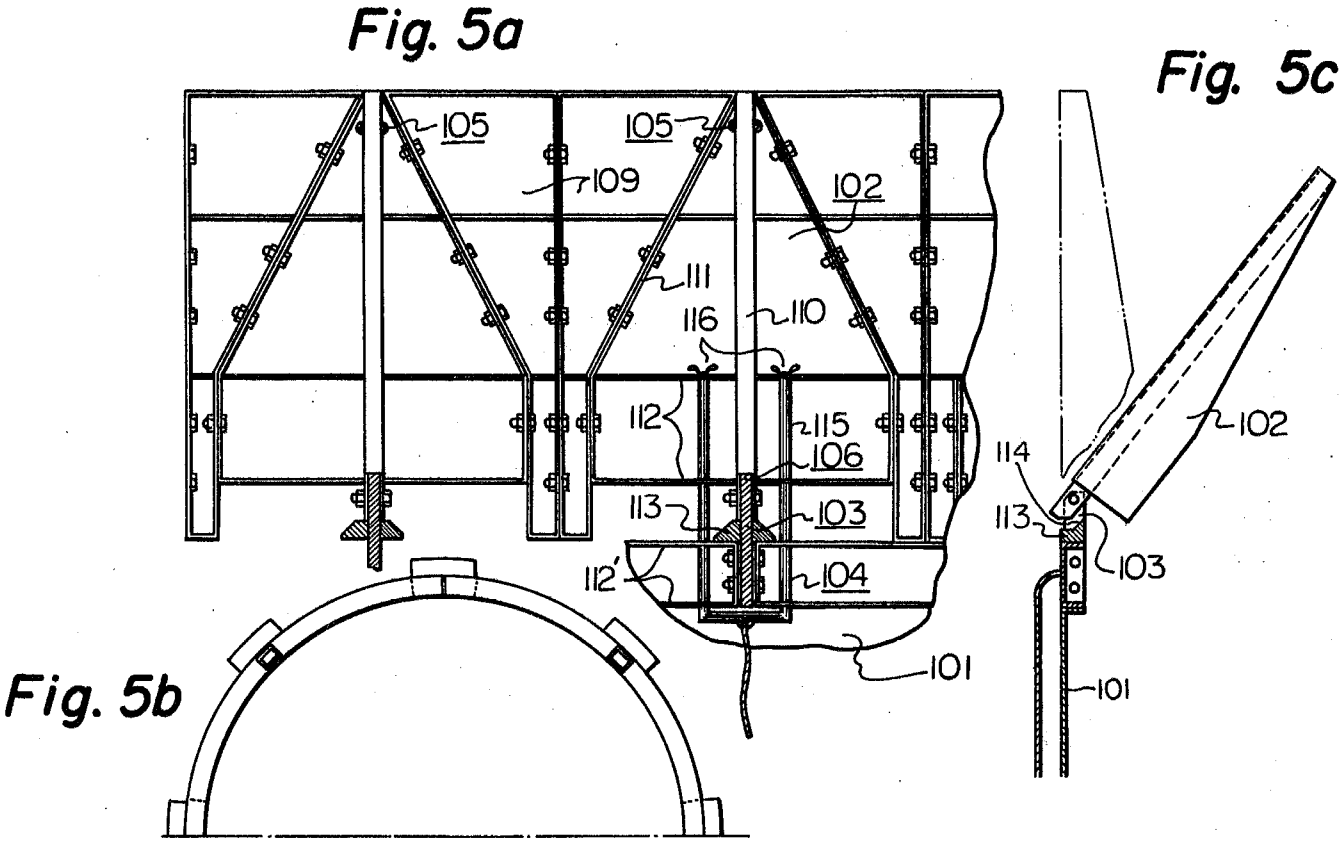

In FIGS. 5*a*–5*c*, there are shown a stretched elevation view of the device for supporting the roof of a shaft according to the present invention as well as a plan view and a side view thereof. In the illustrated example, top supporting plate 102 is an arcuate member of a radius corresponding to that of the cylindrical member. The plate 102 is generally shaped as an isosceles triangle, but the lower part thereof may be of rectangular form. The plate 102 has a column 110 which extends downwardly through the center thereof and is connected to a top supporting plate holder 103 to enable the plate 102 to be rotatably connected to the holder 103. At the outer periphery of the plate 102 are provided peripheral flange members 111 which have slots therein for joining the plate 102 with tie plates 109 by means of bolts. Reinforcing plates 112 are also attached to the top supporting plate 102 and are horizontally disposed.

In FIG. 5*a*, the top supporting plate holder 103 is a rectangular column the lower end of which is inserted in a depression on the upper edge of the cylindrical supporting frame 101 and is fastened thereto by means of bolts. The top of the holder 103 is inserted into the column 110 and connected thereto by means of a single bolt or pin. Since the column 110 is of the channel type which opens to the center of the shaft, the plate 102 is allowed to swing toward the center of the shaft. The holder 103 itself may be of the channel type to receive the column 110 in rotative relationship therewith.

As also shown in FIGS. 5*a* and 5*c*, the top supporting plate holder 103 is fixed to a rim member 113 at a predetermined position on both sides thereof. The lower surface of the above mentioned rim member 113 is engaged with the upper surface of the uppermost cylindrical frame 101, and therefore the top supporting plate 102 is prevented from cranking. The upper surface of the rim member 113 is configurated to contact the lower surface of the column 110 when the top supporting plate 102 is in an upright position to carry the load imposed upon the plate 102, thus preventing overburden on the member connecting the plate 102 with the holder 103 which would otherwise occur.

As shown in FIG. 5*c*, the upper end of the top supporting plate 103 of rectangular form has a tapered face 114 confronting the side wall of the shaft. When the plate 102 falls inwardly from the side wall of the shaft, the inner surface of the column 110 will contact the tapered face 114 and the plate 102 is held on the face 114 in a predetermined angular relationship. The above mentioned mechanism constitutes a stopper 106 which holds the top supporting plate 102 in a sloped position of predetermined angle.

As shown in FIG. 5*a*, reinforcing members 112 as well as horizontally extending members 112' in the side wall support frame 101 are all provided with slots at appropriate positions therein, and rods 15 are inserted therethrough to hold the plate 102 in an upright position, thus forming means 104 for preventing falling of the plate. A split pin 116 having a stretchable tip is provided on the top of each of the rods 115 to prevent the rods from falling down. Thus, in this condition unintended falling or swinging of the top supporting plate 102 is avoided. But when the rod 115 is pulled down by suitable means such as a string, the pin 116 will be closed and, in turn, the rod 115 will fall down to remove means 104 for preventing falling.

Figure 6:
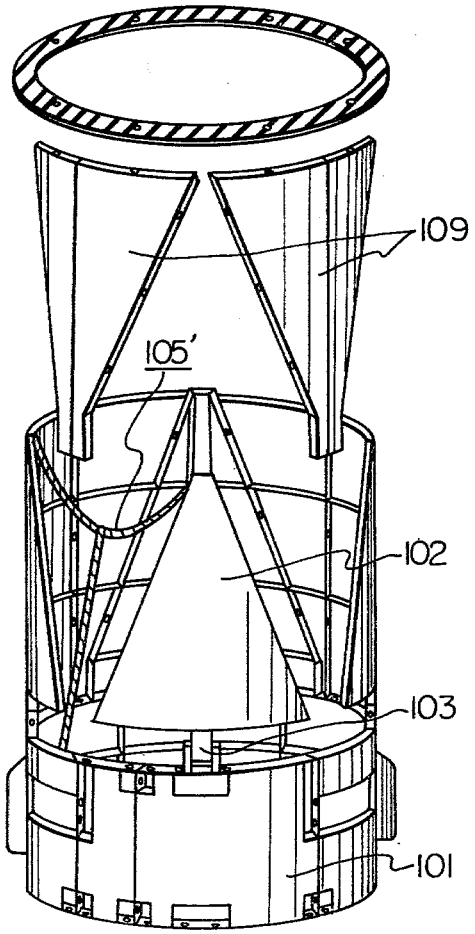

As shown in FIGS. 5*a* and 6, a ring 105 is provided on the upper portion of the top supporting plate 102. Adjacent rings are tied by a first string, and the plate 102 may fall down toward the center of the shaft by pulling downwardly on another string connected to the center of the first string.

As also shown in FIG. 6, connecting plate 109 has the shape of an inverted triangle and covers the space between two plates 102 to enable the plates 102 to serve as a side wall support frame 101. The connecting plate 109 has peripheral frame member 111 at the periphery thereof. The frame member 111 has bolt slots through which bolts are inserted to join the plate 102 with the connecting plate 109. Consequently, the combination of the plates 102 and the plates 109 forms a side wall support frame to prevent the fall of underground rocks from the space between the bit 107 and the support frame or cylindrical frame.

When the cutting operation is terminated, the bolts connecting the plates 102 with the plates 109 are drawn out to detach the plates 109 from the plates 102, thereby leaving the top supporting plates 102 at the top of the side wall supporting frame 101. The plates 102 will then be usable as means for supporting the roof.

FIG. 4 is illustrative of the circumstance wherein the drilling operation or cutting operation is just terminated. The cutting operation is carried out by upwardly cutting a predetermined length of the shaft by a rotary bit 107 and supporting the corresponding length of thus shaped side wall by means of side wall supporting frame, whereby both the cutting and supporting operations are carried out repeatedly. In the cutting operation, the top supporting plates 102 serve as a side wall support frame and are gradually thrust up as the cutting operation proceeds. After the cutting operation is completed, the support frame consisting of the plates 102 and the plates 109 is thrust up close to the lower part of the bit 107, thereby providing a completely shielded shaft.

Workmen can then safely pass through the shaft, and climb on the bit to contract the diameter of the bit 107 for permitting the bit to pass down through the shaft.

The workmen then remove, as shown in FIG. 6, all the bolts connecting the plates 102 and the plates 109 to extract the connecting plates 109. The connecting plates must be extracted one by one under close observation of the condition of the side wall.

When the plates 109 are all removed, the workmen ascertain that the top supporting plates 102 are in pivotal condition, and insert rods 115 through the slots provided in both the reinforcing members 112 and the horizontal members 112' on the side wall supporting frame 101. The split pins 116 are stretched to prevent falling of the rods 115. Thus, means 104 for preventing rotation of the top supporting plates 102 is constructed to hold the plates 102 in the upright position. Thereafter a string of predetermined length is tied at one end to the rods and at the other end to the cutting bit 107.

Rings 105 shown in FIG. 5*a* for rotating the top supporting plates 102 are interconnected by strings, and other strings depend from the center of the interconnecting strings for the purpose of rotating or falling the top supporting plates 102, to thus complete the top supporting plate falling means 105' as shown in FIG. 6. If necessary from the condition of the side wall exposed between the plates 102, nets for preventing falling of rock are used to cover the exposed wall portions before the workmen withdrawn from the shaft.

Figure 7:
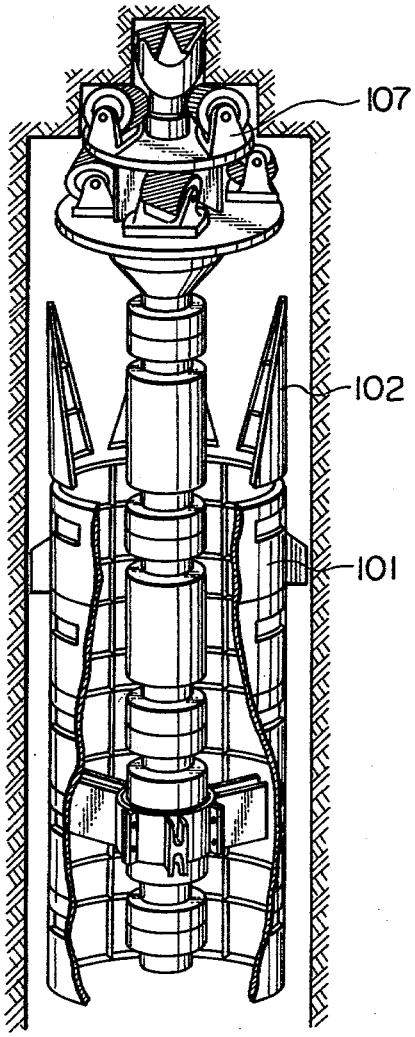

When the above mentioned process of work is over and the workmen have withdrawn, the shaft will be in the condition shown in FIG. 7. Next, the cutting bit 107 is lowered while the series of the top wall support frames 101 is thrust up to locate the top supporting plates 102 close to the roof.

When the cutting bit 107 passes by the top supporting plates 102 and reaches a predetermined position relative to the plates 102, the string which connects the bit 108 with the rods 115 or means for preventing falling of the plates 102 will be strained. Then the split pins 116 are closed and the rods 115 are extracted down from the means 104 to render the plates 102 rotatable.

Figure 8:
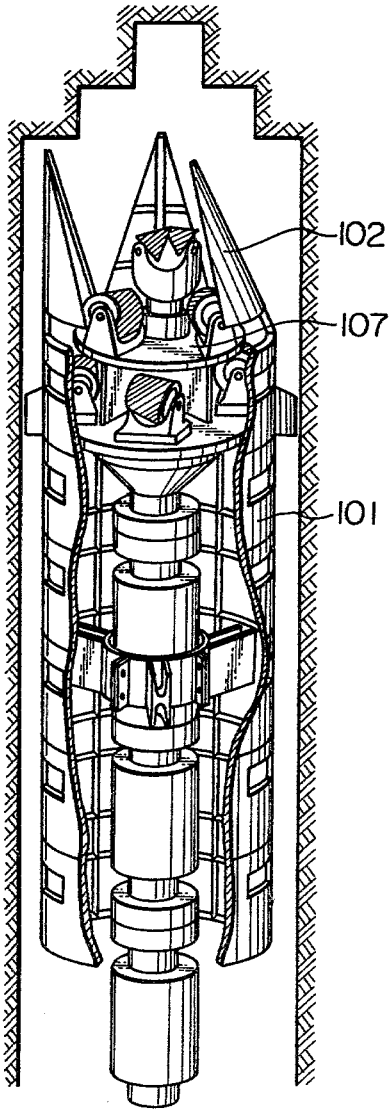

Thereafter, the workman pulls the string connected to the top supporting plate falling means 105', and the plates 102 will rotate around the upper end of the top supporting plate holders 103 to fall down into the shaft, as shown in FIG. 8. The stoppers 106 or means for adjusting the angular position of the plates 102 serve to fix the plates 102 in predetermined angular positions.

Figure 9:
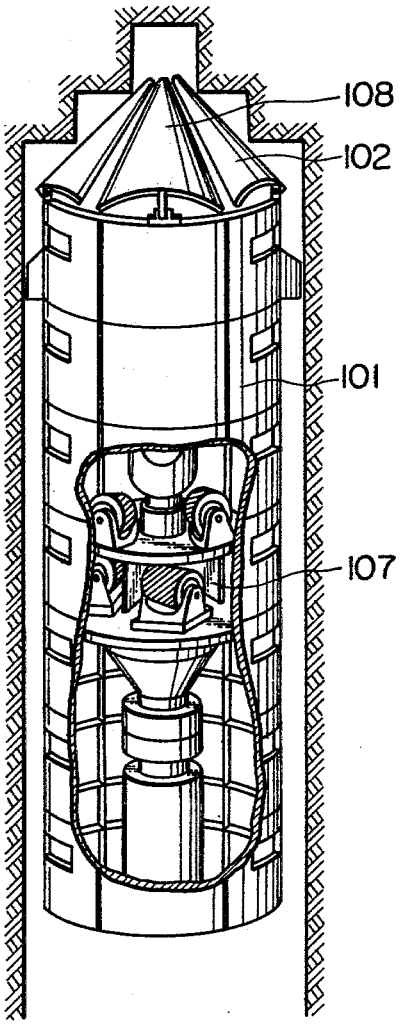

Since a plurality of top supporting plates 102 fall down and are fixed by the stoppers 106, the tops of the plates 102 will come together at the center of the shaft to present the the appearance of an umbrella 108, as shown in FIG. 9. Under such a circumstance, the series of side wall support frames 101 is thrust up to push the gathered plates 102 against the roof, and thus each of the plates 102 is pushed to adjacent plates at the sides thereof to support the roof of the shaft.

Then the bit 107 is lowered and removed, and the shaft will be wholly shielded to allow the workmen to pass therethrough with safety.

From the above description, it will be apparent to those skilled in the art that the present invention provides a method and apparatus for automatically supporting the wall of an upwardly excavated shaft, whereby the shaft may be wholly and promptly shielded without toilsome and difficult manual labor. Thus the present invention is especially advantageous in constructing shafts for prospecting and surveying.

What is claimed is:

1. A support frame assembly for supporting a side wall of a vertically upwardly extending shaft, said support frame assembly being capable of being constructed and inserted upwardly into the shaft without the need for workmen entering the shaft, said support frame assembly being capable of being inserted into the shaft by being intermittently thrust upwardly into the shaft by thrust means and then locked in a vertical position by means of locking means positioned vertically below the shaft, said support frame assembly comprising:

a plurality of arcuate members and a disjointing member adapted to be connected in a side-by-side manner to form a cylindrical support frame;

said arcuate members and said disjointing member having exterior surfaces adapted to face a shaft side wall and interior surfaces adapted to face the center of the shaft when said members are connected to form said support frame;

said exterior surfaces of said arcuate members having therein holding means for engagement with locking means exterior of the shaft for maintaining said support frame in a desired vertical position, and for preventing said support frame from being lowered from said vertical position;

said interior surfaces of said arcuate members and said disjointing member having extending inwardly therefrom peripheral flanges;

connecting means for joining circumferentially adjacent said flanges of said arcuate members and said disjointing member when aligned in said side-by-side manner;

said exterior surfaces of said arcuate members and said disjointing member having therein openings positioned adjacent said connecting means, said openings being of a size and configuration to allow workmen to manipulate said connecting means from exterior of said support frame; and said disjointing member being located between and connected to two of said arcuate members such that, upon removal of the respective said connecting means, said disjointing member may be extracted from between said two arcuate means in a direction toward the interior of said support frame.

2. A support frame assembly as claimed in claim 1, wherein contacting said flanges of said disjointing member and said two arcuate members extend in planes diverging toward the interior of said support frame.

3. A support frame assembly as claimed in claim 1, comprising a plurality of vertically aligned said cylindrical support frames, and further comprising further connecting means for joining vertically adjacent of said cylindrical support frames.

4. A support frame assembly for supporting a side wall of a vertically upwardly extencing shaft, said support frame assembly being capable of being constructed and inserted upwardly into the shaft without the need for workmen entering the shaft, said support frame assembly being capable of being inserted into the shaft by being intermittently thrust upwardly into the shaft by thrust means and then locked in a vertical position by means of locking means positioned vertically below the shaft, said support frame assembly comprising:

a plurality of arcuate members adapted to be aligned to form a cylindrical support frame;

said arcuate members having exterior surfaces adapted to face a shaft side wall and interior surfaces adapted to face the enter of the shaft when said arcuate members are aligned to form said support frame;

said exterior surfaces of said arcuate members having therein holding means for engagement with locking means exterior of the shaft for maintaining said support frame in a desired vertical position, and for preventing said support frame from being lowered from said vertical position;

said interior surfaces of said arcuate members having extending inwardly therefrom peripheral flanges;

a plurality of channel members, each said channel member adapted to be aligned between and connected to two adjacent said arcuate members;

each said channel member having an exterior surface having extending outwardly therefrom peripheral flanges; and connecting means for joining said outwardly extending flanges of each said channel member with respective said inwardly extending flanges of said two arcuate members, at positions such that said channel members have upper ends extending upwardly from upper edges of said arcuate members, and such that said channel members have lower ends recessed upwardly from lower edges of said arcuate members, thereby forming projections extending upwardly from said support frame and recesses extending upwardly into said support frame.

5. A support frame assembly as claimed in claim 4, wherein said upper ends of said channel members are tapered.

6. A support frame assembly as claimed in claim 4, comprising a plurality of vertically aligned said cylindrical support frames, said projections of one said support frame extending upwardly into said recesses in the vertically adjacent said support frame.

7. A roof support structure for supporting the roof of a vertically upwardly excavated shaft, said structure being adapted to be mounted on an upper end of a vertically aligned series of cylindrical side wall support frames, said structure comprising:

a plurality of top supporting plates adapted to be mounted in a peripheral alignment about the upper end of a vertically aligned series of cylindrical side wall support frames;

means for mounting said top supporting plates for movement between a first position whereat said top supporting plates extend axially, and a second position whereat said top supporting plates pivot inwardly toward each other to jointly form a closed roof;

a plurality of connecting plates, each said connecting plate being dimensioned to fit between and be connected to two adjacent said top supporting plates when said top supporting plates are in said first position thereof;

means for connecting said top supporting plates and said connecting plates to thereby form a cylindrical frame capable of supporting a side wall of a shaft, said connecting means being detachable to allow removal of said connecting plates from said top supporting plates, so that said top supporting plates may then be moved to said second position thereof;

means, connected to said top supporting plates, for maintaining said top supporting plates in said first position thereof after removal of said connecting plates, and for selectively moving said top supporting plates into said second position thereof; and stopper means for limiting the amount of movement of said top supporting plates to said second position thereof.

8. A roof support structure as claimed in claim 7, wherein said top supporting plates and said connecting plates are substantially triangular shaped.

9. In a method of forming a vertically upwardly extending shaft without the need for workmen entering the shaft, said method including vertically upwardly cutting a length portion of a shaft by means of an upwardly extending cutting bit, upwardly inserting into said shaft an assembly of vertically aligned and connected cylindrical support frames and thereby supporting the side wall of said length portion of said shaft, and repeating said steps of cutting and inserting while adding new cylindrical support frames to the lower end of said assembly, until said shaft has been formed to a predetermined length, the improvement comprising, upon the completion of said predetermined length of said shaft, supporting the upper roof of said shaft, said step of supporting said roof comprising:

providing the uppermost said cylindrical support frame in the form of a plurality of top supporting plates mounted in a peripheral alignment about the upper end of the next lower of said cylindrical support frames, with said top supporting plates being movable from a first position whereat said top supporting plates extend axially and support said side wall of said shaft, and a second position whereat said top supporting plates pivot inwardly toward each other to jointly form a closed roof structure;

while maintaining said top supporting plates in said first position thereof, contracting the diameter of said cutting bit and withdrawing said cutting bit downwardly through at least a portion of said assembly; and thereafter moving said top supporting plates to said second position thereof, and thereby forming a closed roof structure capable of supporting said shaft roof.

10. A support frame assembly for supporting a roof and a side wall of a vertically upwardly extending shaft, said support frame assembly being capable of being constructed and inserted upwardly into the shaft without the need for workmen entering the shaft, said support frame assembly being capable of being inserted into the shaft by being intermittently thrust upwardly into the shaft by thrust means and then locked in a vertical position by means of locking means positioned vertically below the shaft, said support frame assembly comprising:

an assembly of vertically aligned and connected cylindrical support frames extending upwardly into said shaft to support the side wall thereof;

all of said cylindrical support frames, except the uppermost thereof, comprising:

a plurality of arcuate members connected in a side-by-side manner; and holding means on exterior surfaces of said arcuate members for engagement with locking means exterior of the shaft for maintaining said cylindrical support frame in a desired vertical position, and for preventing said cylindrical support frame from being lowered from said vertical position; and said uppermost cylindrical support frame comprising:

a plurality of top supporting plates mounted in a peripheral alignment about the upper end of the next lower of said cylindrical support frames;

said top supporting plates being movable from a first position whereat said top supporting plates extend axially and support the side wall of the shaft, and a second position whereat said top supporting plates pivot inwardly toward each other to jointly form a closed roof structure;

a plurality of connecting plates, each said connecting plate being dimensioned to fit between and be connected to two adjacent said top supporting plates when said top supporting plates are in said first position thereof;

means for connecting said top supporting plates and said connecting plates to thereby form a cylindrical frame capable of supporting a side wall of a shaft, said connecting means being detachable to allow removal of said connecting plates from said top supporting plates, so that said top supporting plates may then be moved to said second position thereof;

means, connected to said top supporting plates, for maintaining said top supporting plates in said first position thereof after removal of said connecting plates, and for selectively moving said top supporting plates into said second position thereof; and stopper means for limiting the amount of movement of said top supporting plates to said second position thereof.

11. An assembly as claimed in claim 10, wherein said top supporting plates and said connecting plates are substantially triangular shaped.

* * * * *